US005277538A

United States Patent [19]

Theurer et al.

[11] Patent Number: 5,277,538

[45] Date of Patent: Jan. 11, 1994

[54] LOADING CAR FOR BULK MATERIAL

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 839,247

[22] Filed: Feb. 20, 1992

[30] Foreign Application Priority Data

Mar. 26, 1991 [AT] Austria ..... 663/91

[51] Int. Cl.[5] ..... B65G 67/24

[52] U.S. Cl. ..... 414/505; 105/157.1; 198/302; 213/220; 414/339; 414/523; 414/528

[58] Field of Search ..... 414/339, 398, 346, 502, 414/503, 505, 523, 528; 105/157.1, 199.1, 215.2; 213/220; 198/302, 311, 314, 588, 594

[56] References Cited

U.S. PATENT DOCUMENTS

| | | | |
|---|---|---|---|
| 1,458,043 | 6/1923 | Follansbee | 414/398 |
| 2,896,771 | 7/1959 | Mecham | 198/311 |
| 3,167,193 | 1/1965 | Klosk | 414/339 X |
| 3,184,038 | 5/1965 | Petchuk | 198/588 |
| 3,343,502 | 9/1967 | Merritt | 105/215.2 |
| 3,512,669 | 5/1970 | Benedict et al. | 414/523 X |
| 3,687,276 | 8/1972 | Pelletier | 198/314 |
| 4,534,297 | 8/1985 | Johnson, Sr. | 105/215.2 X |
| 4,655,916 | 4/1987 | Schlesiger | 414/339 X |
| 4,795,264 | 1/1989 | Riker | 414/528 X |
| 4,909,699 | 3/1990 | Tandy et al. | 414/528 |
| 4,919,583 | 4/1990 | Speakman, Jr. | 198/314 X |
| 4,925,356 | 5/1990 | Snead et al. | 414/528 X |
| 5,029,532 | 7/1991 | Snead | 414/339 X |
| 5,131,798 | 7/1992 | Bell et al. | 414/528 X |

FOREIGN PATENT DOCUMENTS

| | | |
|---|---|---|
| 361978 | 4/1981 | Austria . |
| 206590 | 12/1986 | European Pat. Off. . |
| 368046 | 5/1990 | European Pat. Off. . |
| 2751858 | 6/1982 | Fed. Rep. of Germany . |
| 95026 | 1/1973 | German Democratic Rep. . |

*Primary Examiner*—David A. Bucci
*Attorney, Agent, or Firm*—Collard & Roe

[57] ABSTRACT

A loading car for receiving, conveying and discharging bulk material onto a bulk material freight car comprises an elongated machine frame end and undercarriages supporting the machine frame on a track for mobility therealong in an operating direction. An inclined, elongated conveyor band arrangement for the bulk material is mounted on the machine frame and has a lower receiving end including a hopper arranged to receive bulk material for upward conveyance by the conveyor band arrangement, and a drive is provided for vertically adjusting the rear undercarriage relative to the machine frame.

10 Claims, 2 Drawing Sheets

LOADING CAR FOR BULK MATERIAL

BACKGROUND OF THE INVENTION

1. Field of the Invention

The present invention relates to a loading car for receiving, conveying and discharging bulk material onto a bulk material freight car, which comprises an elongated machine frame, undercarriages supporting the machine frame on a track for mobility therealong in an operating direction, and an inclined, elongated conveyor band arrangement for the bulk material, the conveyor band arrangement being mounted on the machine frame and having a lower receiving end including a hopper arranged to receive bulk material for upward conveyance by the conveyor band arrangement.

2. Description of the Prior Art

German Democratic Republic patent No. 95,026 discloses a loading car comprising a machine frame supported by undercarriages on a track and an inclined, elongated conveyor band having a lower receiving end arranged to receive bulk material for upward conveyance. Hoppers are mounted above the lower receiving end and below the upper discharge end of the conveyor band. The hopper mounted below the conveyor band discharge end is vertically spaced sufficiently from the machine frame to permit a car on the machine frame to be driven under this hopper for being loaded with the bulk material discharged therefrom. This arrangement requires the car to be loaded, for example a power shovel, to be lifted onto the machine frame and cannot be used for loading a vehicle running on the same track as the loading car.

German patent No. 2,751,858 discloses an apparatus for excavating ballast. This apparatus comprises a machine frame supported for mobility on a track and a power shovel arranged on the rear end of the machine frame for excavating ballast and sub-soil after the track ties have been removed. An inclined conveyor band arrangement having a lower receiving end is mounted on the machine frame for receiving the ballast and subsoil from the power shovel and for conveying it upwardly. This lower conveyor arrangement receiving end is supported on the track and has a special hopper with a displaceable end wall for discharging the bulk material received from the power shovel to the conveyor band. The structure of this apparatus is quite complicated.

Austrian patent No. 361,978 discloses a car designed to climb steep hills. It comprises a first frame supported on undercarriages and a second frame pivoted to the first frame for pivoting about a transverse axis. A vertical adjustment drive connects the second frame to the first frame for raising the second frame from the first frame by pivoting about the transverse axis.

Published European patent applications Nos. 206,590 and 368,046 disclose track-bound freight cars for bulk material, which comprise inclined conveyor bands for conveying the bulk material.

SUMMARY OF THE INVENTION

It is the primary object of this invention to provide a bulk material loading car of the first-described type which is simple in construction and requires a minimum of retrofitting while being able to be loaded from a bulk material transfer apparatus positioned on a plane lower than that of the track on which the loading car runs.

The above and other objects are accomplished according to the invention with a loading car for receiving, conveying and discharging bulk material onto a bulk material freight car, which comprises an elongated machine frame having a rear end and undercarriages supporting the machine frame on a track for mobility therealong in an operating direction. The undercarriages include a rear undercarriage adjacent the machine frame rear end and vertically adjustable relative to the elongated machine frame. An inclined, elongated conveyor band arrangement for the bulk material is mounted on the machine frame and has a lower receiving end including a hopper arranged adjacent the rear end to receive bulk material for upward conveyance by the conveyor band arrangement, and drive means is provided for vertically adjusting the rear undercarriage relative to the machine frame.

This simple vertical adjustability enables the lower receiving end of the conveyor band arrangement to be rapidly lowered so that it may be loaded without difficulty even from a bulk material transfer apparatus, such as a power shovel, which is positioned below the plane of the track. To obtain a similar lowering of the conveyor band arrangement receiving end by longitudinally displacing the conveyor band arrangement, it would have to be displaced considerably to project beyond the rear end of the machine frame and to be supported by auxiliary support devices in a time-consuming operation. If this were to be effected in a track curve, the projecting receiving end of the conveyor band arrangement would be eccentrically positioned with respect to the track, which is an added disadvantage. In contrast thereto, the lower conveyor band arrangement receiving end in the loading car of the invention has the advantage that it remains stably fixed to the machine frame even in its lowest position so that it may readily absorb the considerable impact forces to which it is subjected, for example, when a load of 1.5 cubic meters of bulk material, for instance, is released and unloaded from a power shovel onto the receiving end of the conveyor band arrangement.

The rear undercarriage is preferably mounted on the machine frame for pivoting about an axis extending transversely to the elongated machine frame and two connecting rods are connected to the rear undercarriage and extend along the sides of the machine frame for pivoting the rear undercarriage about this axis and thereby to adjust the vertical distance. This assures a stable anchoring of the rear undercarriage to the machine frame while enabling it to be vertically adjusted by pivoting.

The machine frame defines a plane and respective buffer couplings may be affixed to the ends of the machine frame in this plane. The machine frame further defines an opening at the rear end for receiving the undercarriage upon pivoting. This enables the lower conveyor band arrangement receiving end to be vertically adjusted over a relatively large vertical distance for adaptation to various loading conditions.

The conveyor band arrangement may comprise an inclined receiving conveyor band having the lower receiving end including the hopper and an upper discharge end, and a longitudinally displaceable, inclined transfer conveyor band having a lower input end arranged to receive conveyed bulk material from the upper discharge end of the receiving conveyor band, the receiving conveyor band trailing the transfer conveyor band in the operating direction. The transfer conveyor may be longitudinally displaced between an operating position in which its upper output end may discharge the conveyed bulk material into an adjacent freight car and a retracted transit position.

If the lower input end of the transfer conveyor band is pivotal about an axis extending vertically thereto and may be pivoted by a drive supported on the machine frame about the vertically extending axis, the conveyed bulk material may be discharged into the freight car without problems in track curves, too. Usefully, a support frame is affixed to the machine frame, the pivoting drive connecting the transfer conveyor input end to the support frame and a transversely displaceable roller slide supporting the pivotal lower input end of the transfer conveyor on the support frame.

The trailing receiving conveyor band defines a conveying plane and, according to a preferred feature, is longitudinally displaceably mounted on the machine frame for displacement in this plane. While the loading car may be readily coupled without interference by the longitudinal displacement of the receiving conveyor band, this conveyor band may be displaced into the most favorable loading position.

According to one preferred embodiment, the rear end of the machine frame carries a buffer coupling and the lower receiving end of the conveyor band arrangement is arranged immediately above the buffer coupling. This provides a favorable low position of the conveyor band arrangement receiving end even without vertical adjustment of the rear undercarriage.

The machine frame preferably defines a plane and the lower receiving end of the conveyor band arrangement may be arranged below the machine frame plane. This arrangement makes it possible to provide a rear buffer coupling on the machine frame while assuring free access to the conveyor band arrangement receiving end for loading the bulk material.

According to another embodiment, the loading car comprises a carrier frame for a buffer coupling at the rear end of the machine frame, the buffer coupling carrier frame being pivoted to the rear end of the machine frame for pivoting about an axis extending transversely to the machine frame, and a drive for pivoting the carrier frame about said axis. The illustrated carrier frame comprises a transversely extending front beam carrying the buffer coupling and two parallel side beams extending perpendicularly to the front beam, the carrier frame beams defining a U-shaped opening and the side beams of the carrier frame being pivoted to the rear end of the machine frame. This arrangement provides rapid adjustability while assuring that the buffer coupling will be sufficiently stress-resistant.

BRIEF DESCRIPTION OF PREFERRED EMBODIMENTS

The above and other objects, advantages and features of the present invention will become more apparent from the following detailed description of certain preferred embodiments thereof, taken in conjunction with the accompanying schematic drawing wherein FIG. 1 is a side elevation showing a loading car for receiving, conveying and discharging bulk material onto a bulk material freight car preceding the loading car in the operating direction;

DETAILED DESCRIPTION OF PREFERRED EMBODIMENTS

Figure 1:
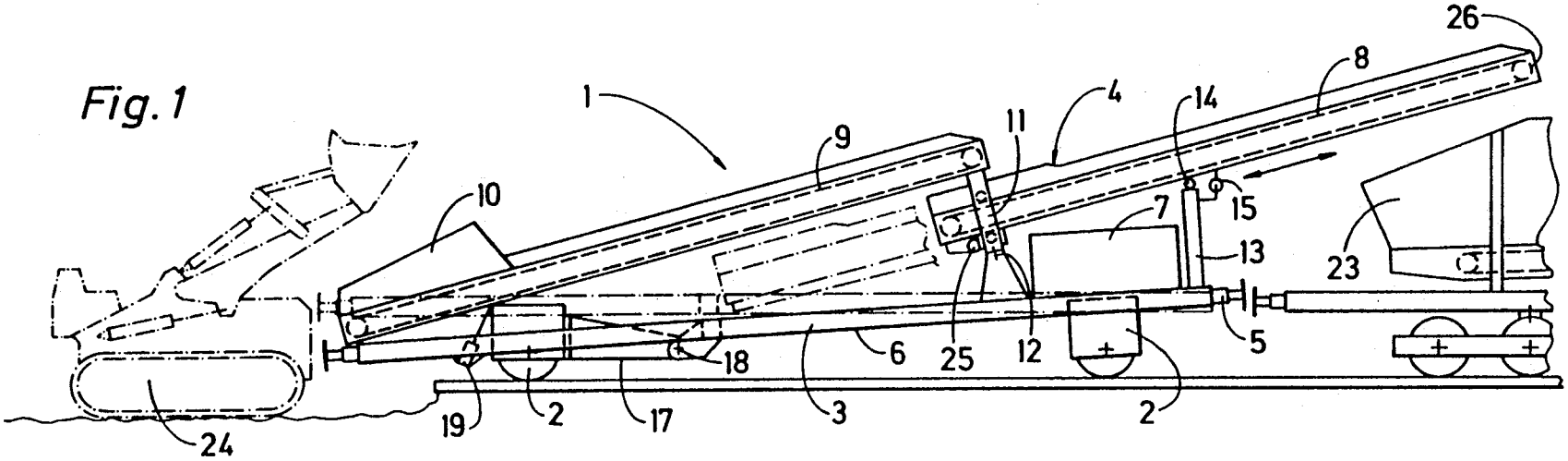
Figure 2:
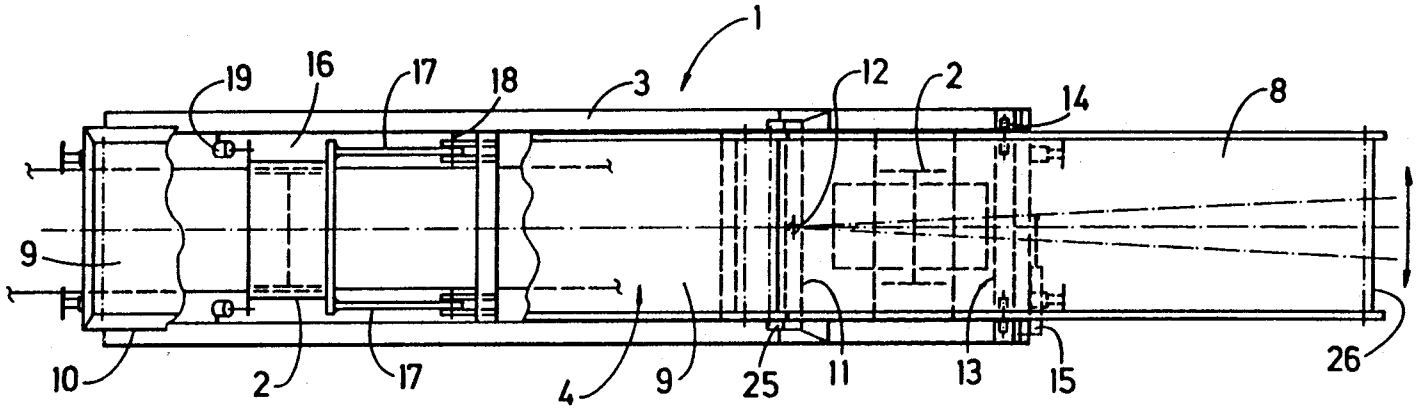
FIG. 2 is a diagrammatic top view of the loading car.

Referring now to the drawing and first to FIGS. 1 and 2, there is shown loading car 1 for receiving, conveying and discharging bulk material onto bulk material freight car 23. The loading car comprises elongated machine frame 3 having a rear end and undercarriages 2, 2 including a rear undercarriage at the rear end supporting the machine frame on a track for mobility therealong in an operating direction. Inclined, elongated conveyor band arrangement 4 for the bulk material is mounted on machine frame 3 and has a lower receiving end including hopper 10 arranged adjacent the rear end to receive bulk material for upward conveyance by the conveyor band arrangement. Elongated machine frame 3 defines plane 6 and buffer couplings 5, 5 are mounted in this plane at the front and rear ends of the machine frame. Central power plant 7 on machine frame 3 supplies energy to the various operating drives.

According to this invention, rear undercarriage 2 is vertically adjustably mounted on elongated machine frame 3 and drives 19 connect rear undercarriage 2 and machine frame 3 for vertically adjusting the rear undercarriage relative to the machine frame.

As shown in FIGS. 1 to 4, rear undercarriage 2 is mounted on machine frame 3 for pivoting about axis 18 extending transversely to the elongated machine frame and two connecting rods 17, 17 are connected to the rear undercarriage and extend along the sides of machine frame 3 towards the front undercarriage for pivoting the rear undercarriage about axis 18 and thereby to adjust the rear undercarriage vertically relative to the machine frame.

As shown in FIG. 2, machine frame 3 defines opening 16 at the rear end for receiving rear undercarriage 2 upon upward pivoting thereof about axis 18 by drives 19. Furthermore, in the illustrated embodiment, conveyor band arrangement 4 comprises inclined receiving conveyor band 9 having the lower receiving end including hopper 10 and an upper discharge end, and longitudinally displaceable, inclined transfer conveyor band 9 having a lower input end arranged to receive conveyed bulk material from the upper discharge end of receiving conveyor band 8. The receiving conveyor band trails transfer conveyor band 9 in the operating direction, and the lower input end of the transfer conveyor band is longitudinally displaceably mounted in guide frame 11 for retraction into a transit position indicated in phantom lines in FIG. 1. Guide frame 11 is connected to elongated machine frame 3 for pivoting about axis 12 extending perpendicularly to the plane defined by the transfer conveyor. Support frame 13 is affixed to machine frame 3 and pivoting drive 15 connects the transfer conveyor input end to support frame 13 for pivoting the transfer conveyor band input end about vertical axis 12. Roller slide 14 supports the pivotal lower input end of the transfer conveyor band on support frame 13 for transverse displacement of the conveyor band input end upon pivoting thereof.

In the illustrated embodiment, trailing receiving conveyor band 9 is also longitudinally displaceably mounted on the machine frame for displacement in its conveyor plane.

In the embodiment illustrated in FIGS. 1 and 2, the rear end of machine frame 3 carries a buffer coupling and the lower receiving end of the conveyor band arrangement is arranged immediately above the buffer coupling unless the rear end is raised by drive 19 into the position shown in phantom lines in FIG. 1, in which the lower receiving end of the conveyor band arrangement is arranged below the machine frame plane.

Figure 3:
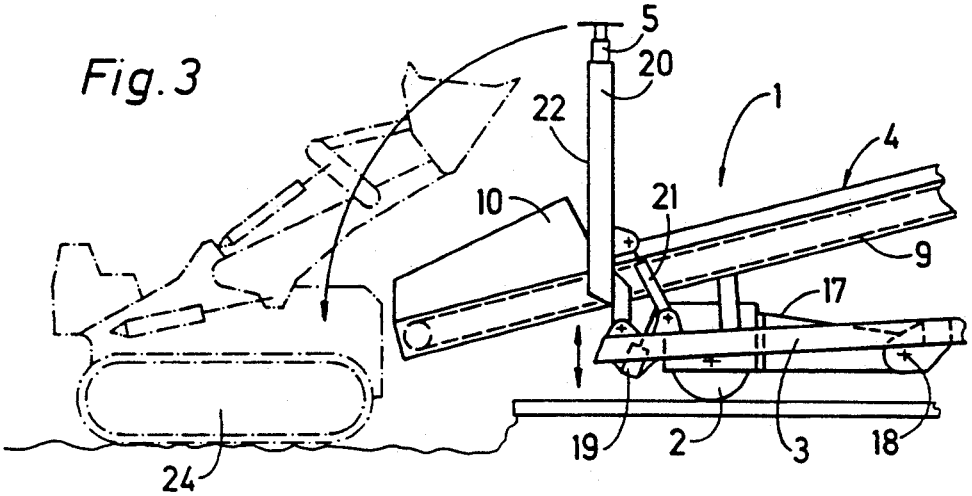
FIG. 3 is a fragmentary side elevational view of the rear end of the loading car, showing another embodiment.
Figure 4:
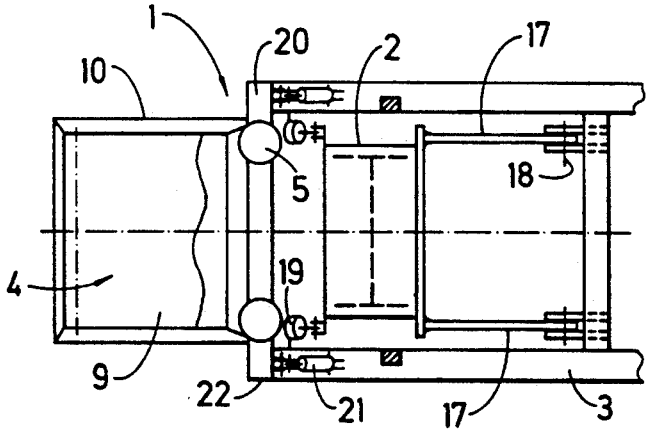
FIG. 4 is a top view of FIG. 3.

FIGS. 3 and 4 show an embodiment comprising a carrier frame 20 for a buffer coupling 5 at the rear end of machine frame 3, buffer coupling carrier frame 20 being pivoted to the rear end of the machine frame for pivoting about an axis extending transversely to the machine frame, and drive 21 for pivoting carrier frame 20 about this axis. The carrier frame comprises a transversely extending front beam carrying the buffer coupling and two parallel side beams 22 extending perpendicularly to the front beam, the carrier frame beams defining a U-shaped opening and the side beams of the carrier frame being pivoted to the rear end of the machine frame.

In operation, loading car 1 is driven to a track working site into a position where hopper 10 overhangs the site at which bulk material, such as soil and/or ballast, is excavated by full track power shovel 24 (shown in phantom lines). The power shovel loads the excavated bulk material through funnel-shaped hopper 10 onto conveyor arrangement 4 which conveys the bulk material to output end 26 whence it is discharged into freight car 23. After loading car 1 has arrived at the working site, drives 19 are actuated to lower the rear end of elongated machine frame 3 relative to rear undercarriage 2 into the operating position shown in full lines in FIG. 1, and winch drive 25 is actuated to displace transfer conveyor 8 from its retracted position indicated in phantom lines in FIG. 1 to its forward position shown in full lines, in which output end 26 of the transfer conveyor band is located above freight car 23 for discharging the conveyed bulk material into the box of the freight car. In track curves, pivoting drive 15 is actuated to center transfer conveyor band output end 26 above the freight car box.

The embodiment illustrated in FIGS. 3 and 4 offers the added possibility of moving power shovel 24 closer to hopper 10 by pivoting buffer coupling carrier frame 20 upwardly, as shown in the drawing. After the loading operation has been completed, the buffer coupling carrier frame is pivoted back into the plane of machine frame 3 and is locked in position so that buffer coupling 5 enables loading car 1 to be coupled to another car. At the same time, drives 19 are actuated to return elongated machine frame 3 to its normal position (shown in phantom lines in FIG. 1) substantially parallel to the track plane. Upon retracting transfer conveyor band 8 by actuating drive 25, loading car 1 is ready for transit to another operating site.

Figure 5:
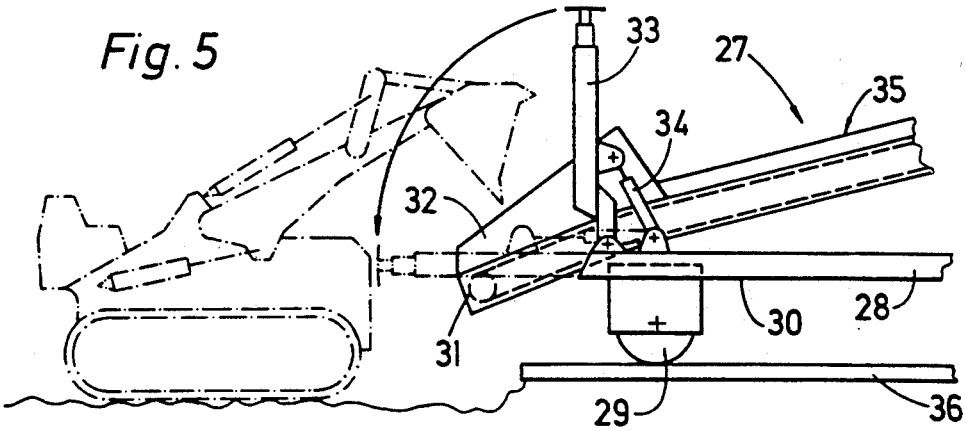
FIG. 5 is a fragmentary side elevational view of the rear end of the loading car, showing yet another embodiment.

FIG. 5 illustrates the rear end of loading car 27 comprising elongated machine frame 28, rear undercarriage 29 and inclined conveyor band arrangement 35. Lower receiving end 31 of the conveyor band arrangement extends below plane 30 of the machine frame and has hopper 32. Similarly to the embodiment of FIGS. 3 and 4, buffer coupling carrier frame 33 is pivoted to the rear end of the machine frame and is pivotal by drives 34 about a transversely extending axis. The end portion of conveyor band arrangement 35 extending below machine frame plane 30 and carrying hopper 32 is more strongly inclined towards track 36 than the remainder of the conveyor band arrangement. This positions lower receiving end 31 relatively low for effective loading even without vertically adjusting rear undercarriage 29 relative to machine frame 28.

What is claimed is:

1. A loading car for receiving, conveying and discharging bulk material onto a bulk material freight car, which comprises (a) an elongated machine frame having two sides, a rear end and a front end, (b) undercarriages supporting the machine frame on a track for mobility therealong in an operating direction, the undercarriages including a rear undercarriage adjacent the rear end and the rear undercarriage being vertically adjustable relative to the machine frame, (1) the rear undercarriage being mounted on the machine frame for pivoting about an axis extending transversely to the elongated machine frame, (c) two connecting rods connected to the rear undercarriage and extending along the sides of the machine frame for pivoting the rear undercarriage about said axis and thereby to adjust the rear undercarriage vertically relative to the machine frame, (d) an included, elongated conveyor band arrangement for the bulk material, the conveyor band arrangement being mounted on the machine frame and having a lower receiving end including a hopper arranged adjacent the rear end to receive bulk material for upwards conveyance by the conveyor band arrangement, and (e) drive means for vertically adjusting the rear undercarriage.

2. The loading car of claim 1, wherein the machine frame defines a plane, respective buffer couplings are affixed to the ends of the machine frame in said plane, the machine frame defining an opening at the rear end for receiving the undercarriage upon pivoting thereof about said axis.

3. The loading car of claim 1, wherein the conveyor band arrangement comprises an inclined receiving conveyor band having said lower receiving end including the hopper and an upper discharge end, and a longitudinally displaceable, inclined transfer conveyor band having a lower input end arranged to receive conveyed bulk material from the upper discharge end of the receiving conveyor band, the receiving conveyor band trailing the transfer conveyor band in the operating direction.

4. The loading car of claim 3, wherein the lower input end of the transfer conveyor band is pivotal about an axis extending vertically thereto, further comprising a drive supported on the machine frame for pivoting the transfer conveyor band about the vertically extending axis.

5. The loading car of claim 4, further comprising a support frame affixed to the machine frame, the pivoting drive connecting the transfer conveyor band input end to the support frame, and a roller slide supporting the pivotal lower input end of the transfer conveyor band on the support frame for transverse displacement upon pivoting.

6. The loading car of claim 3, wherein the trailing receiving conveyor band defines a conveying plane and is longitudinally displaceably mounted on the machine frame for displacement in said plane.

7. The loading car of claim 1, wherein the rear end of the machine frame carries a buffer coupling and the lower receiving end of the conveyor band arrangement is arranged immediately above the buffer coupling.

8. The loading car of claim 1, wherein the machine frame defines a plane and the lower receiving end of the conveyor band arrangement is arranged below the machine frame plane.

9. A loading car for receiving, conveying and discharging bulk material onto a bulk material freight car, which comprises (a) an elongated machine frame having a rear end, (b) undercarriages supporting the machine frame on a track for mobility therealong in an operating direction, the undercarriages including a rear undercarriage adjacent the rear end and the rear undercarriage being vertically adjustable relative to the machine frame, (c) an included, elongated conveyor band arrangement for the bulk material, the conveyor band arrangement being mounted on the machine frame and having a lower receiving end including a hopper arranged adjacent the rear end to receive bulk material for upwards conveyance by the conveyor band arrangement, (d) drive means for vertically adjusting the rear undercarriage.

(e) a carrier frame for a buffer coupling at the rear end of the machine frame, (1) the buffer coupling carrier frame being pivoted to the rear end of the machine frame for pivoting about an axis extending transversely to the machine frame, and (f) a drive for pivoting the carrier frame about said axis.

10. The loading car of claim 9, wherein the carrier frame comprises a transversely extending front beam carrying the buffer coupling and two parallel side beams extending perpendicularly to the front beam, the carrier frame beams defining a U-shaped opening and the side beams of the carrier frame being pivoted to the rear end of the machine frame.

* * * * *